United States Patent [19]

Fox

[11] Patent Number: 5,070,712

[45] Date of Patent: Dec. 10, 1991

[54] LOCKING DEVICE

[76] Inventor: David Fox, RR #r Hayward Rd., Saint John, New Brunswick, Canada, E2L 3W4

[21] Appl. No.: 588,901

[22] Filed: Sep. 27, 1990

[51] Int. Cl.[5] ..... E05B 73/00

[52] U.S. Cl. ..... 70/18; 70/19; 70/49

[58] Field of Search ..... 70/14, 15, 19, 33, 49, 70/57, 58, 18

[56] References Cited

U.S. PATENT DOCUMENTS 1,520,902 12/1924 Junkune ..... 70/49
2,623,378 12/1952 Haver ..... 70/49
3,765,196 10/1973 Balicki ..... 70/49
3,841,118 10/1974 Stone ..... 70/33
3,987,653 10/1976 Lyon ..... 70/19

*Primary Examiner*—Robert L. Wolfe
*Attorney, Agent, or Firm*—Joseph A. Day

[57] ABSTRACT

There is disclosed a novel locking device adapted for use with a length of flexible cable. The locking device comprises a body member designed to receive a flexible cable and a pivotable cable retaining member pivotally associated with one end of the body member and designed to work in conjunction with the body member to engage the flexible cable thereby allowing for the simple engagement of articles to be locked together.

9 Claims, 2 Drawing Sheets

LOCKING DEVICE

FIELD OF THE INVENTION

The present invention relates to a locking device adapted for use with a length of flexible cable.

BACKGROUND OF THE INVENTION

Locking devices are known in the art including devices for specially looped cables and chain arrangements. One example of a prior art device is disclosed by Foote in U.S. Pat. No. 3,783,656. This document discloses cable clamps having bores extending longitudinally therethrough, receive cable ends which form loops. Within the clamp are internal protuberances which "bite" into the cable end inserted therein. Smith, in U.S. Pat. No. 3,886,770, discloses a double locking security apparatus comprising a length of flexible cable with looped ends and a third loop located intermediate of the end loops. The result of this arrangement is the formation of two locking areas when situated about an article.

Further, Stuart, in U.S. Pat. No. 4,185,361, discloses a device for locking articles which includes a pair of flexible cable lengths each having looped ends. An intervening length of chain is connected to one looped end of each cable. The loops and chain links may be engaged and shackled. This arrangement is limited since it employs a chain which is susceptible to rust and, additionally, easily scratches equipment about which it is placed.

In both the Stuart and Foote documents a chief limitation of arrangements disclosed therein is the lack of adjustability. The result in both cases is a loosely secured article which inherently allows the cable to be easily cut in an act of thievery.

Other U.S. Patent documents relating to such subject matter include: U.S. Pat. Nos. 4,531,661, 3,590,608 and 3,091,011.

BRIEF SUMMARY OF THE INVENTION

The present invention provides a locking device having a body of rigid material with a recessed opening therein. The body includes an aperture therein to allow a flexible cable to extend therethrough. The length of cable is slidably adjustable through the aperture. An opening, e.g. a groove spaced from the aperture, permits retention of another portion of the flexible cable, for example a looped portion. An additional aperture extends through the body spaced from the groove. A pivotally connected cable retaining element, associated with one end of the body, pivots to cooperate for engagement and disengagement within the body. The element is provided with openings which register with the aperture and groove of the body to frictionally contact the portions of cable therein in an engaged position. The element and body each include a further aperture extending therethrough which, when the element is engaged with the body, align and register thus, being adapted to receive locking means, e.g. a pad or combination lock. It is therefore an object of the present invention to provide a locking device which allows for simple engagement of articles to be locked together.

It is another object of the present invention to provide a locking device having a pivotable component which is pivotally movable from an engaged position to a disengaged position.

It is yet another object of the present invention to provide a locking device which allows an associated flexible cable to be adjusted therein.

It is a further object of one embodiment of the present invention to provide a locking device comprising: a body member, the body member having first and second spaced apart apertures therethrough, the first aperture being adapted to receive a length of flexible cable having opposed ends, at least one of the ends being looped, the body further including a recessed opening therein, the recessed opening including at least one groove adapted to receive at least one of the looped ends of the cable, the groove spaced from and between the first and second apertures; a pivotable cable retaining member, the member being pivotally associated with one of the ends of the body, the retaining member having first and second spaced apart openings therein and an aperture extending through an end thereof movable from an engaged position with the opening of the body and the first and second openings and the aperture of the retaining member are engaged with the first aperture, the groove and the second aperture of the body to engage a cable therein to a disengaged position wherein the cable retaining member is out of engagement with the opening of the body.

In one form of the invention, the cable retaining member comprises a finger pivotally movable at one of the opposed ends of the device and received within the recessed opening.

In another form, the body may be circular with a correspondingly shaped cable retaining element or finger.

In yet another form, the body may include, on one of the spaced apart sides, a plurality of grooves therein to receive a cable end.

BRIEF DESCRIPTION OF THE DRAWINGS

Having thus generally described the invention, reference will now be made to the accompanying drawings, in which.

DETAILED DESCRIPTION OF THE PREFERRED EMBODIMENTS

Figure 1:
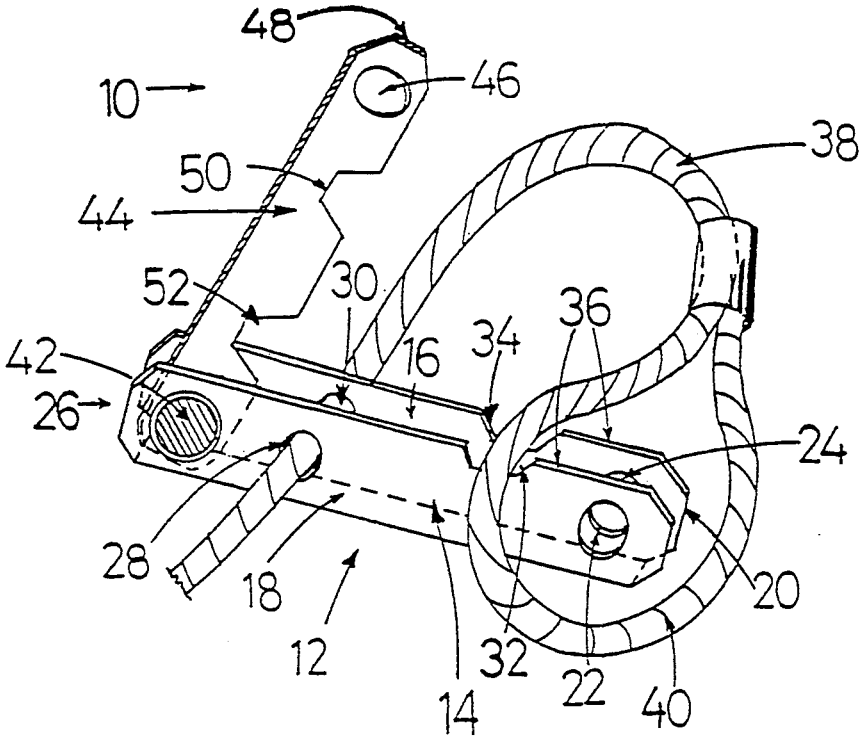
FIG. 1 is a perspective view of a locking device of the present invention shown in a disengaged position.

Referring to FIG. 1, shown is a perspective view of the locking device 10 in a disengaged position. The device comprises an elongated body member 12 preferably manufactured from a rigid material e.g. aluminum, steel, etc. The body member includes a pair of spaced apart walls 14 and 16 and back wall 18 which collectively define a recessed opening within the body 12. e.g. a slot. It is preferred that an end 20 of the body 12 include, spaced inwardly therefrom, an aperture 22 extending through wall 14 and into the recessed opening of the body 12. Similarly, wall 16 includes an aperture 24 extending therethrough and in alignment with aperture 22. Spaced inwardly from an end 26 of the body 12 there is preferably included a further aperture 28 extending through wall 14 which is in alignment with another corresponding aperture 30 in wall 16. It is particularly preferred that the body 12 include openings 32 and 34 extending downwardly from the top 36 of walls 14 and 16.

Openings 32 and 34 define, for example, a groove in the recessed opening, which is adapted to accept a portion of flexible cable 38, e.g. a looped portion 40. Another portion of the cable 38 may be inserted through the apertures 28 and 30 in walls 14 and 16. The cable 38 is slidably adjustable within the apertures 28 and 30. Spaced inwardly from end 26 of the body 12 there is included a pivot member 42 extending between and therethrough walls 14 and 16 and pivotally connecting a cable retaining member 44 therebetween for pivotal movement within the recessed opening of body 12 defined by walls 14, 16 and 18.

Figure 2:
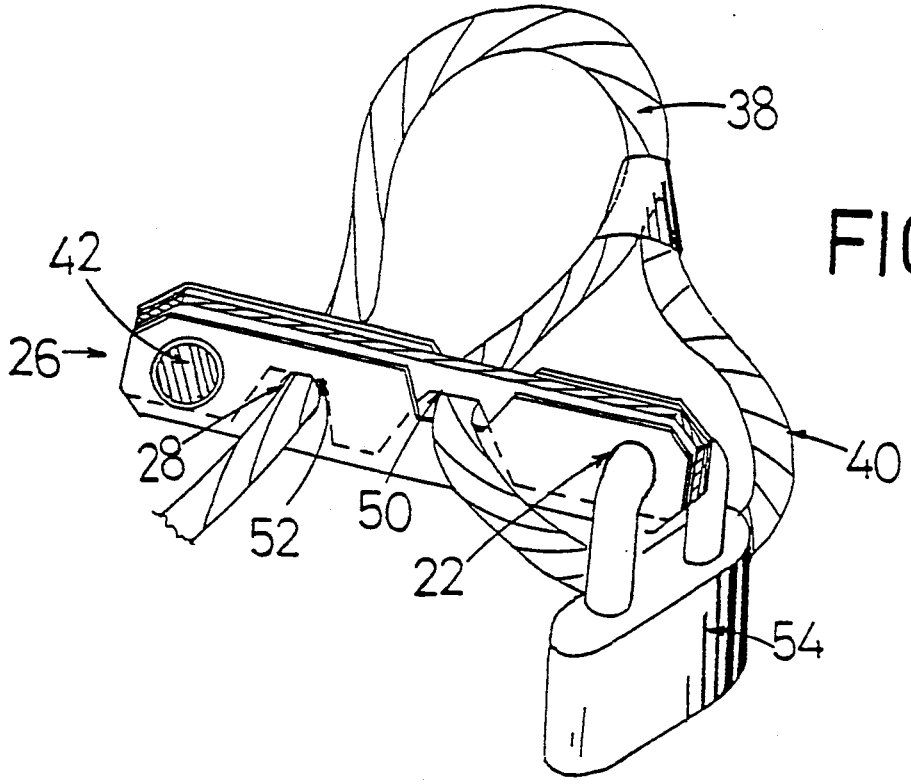
FIG. 2 is a perspective view of the locking device of FIG. 1 in an engaged position.

Retaining member 44 has an aperture 46 extending therethrough spaced inwardly from an end 48 thereof and preferably includes a pair of spaced apart openings 50 and 52 therein. The openings 50,52 are positioned on element 44 in order to register in alignment in an engaged position, with the cable 38 extending between walls 14 and 16 through apertures 28, 30 and openings 32, 34. The openings 50 and 52 are preferably shaped, e.g. to be of a grooved, concave, wedged, etc. configuration to facilitate positive contact and engagement of element 44, when pivoted to an engaged position shown in FIG. 2, to force cable 38, extending through apertures 28, 30 and grooves 32, 34, into the recessed opening of the body 12 and against the interior of wall 18. The aperture 46 within element 44 registers in alignment with apertures 22, 24 of body 12 to permit lock or shackle means, e.g. a pad or combination lock 54, as shown in FIG. 2, to engage the same when the element 44 is in an engaged position. In such an arrangement, the cable 38 through apertures 28, 30 and grooves 32, 34 of walls 14 and 16 is prevented from any slipping therethrough. When element 44 is engaged within body 12, the result is a tamper-proof, fixedly secured locking device.

Figure 3:
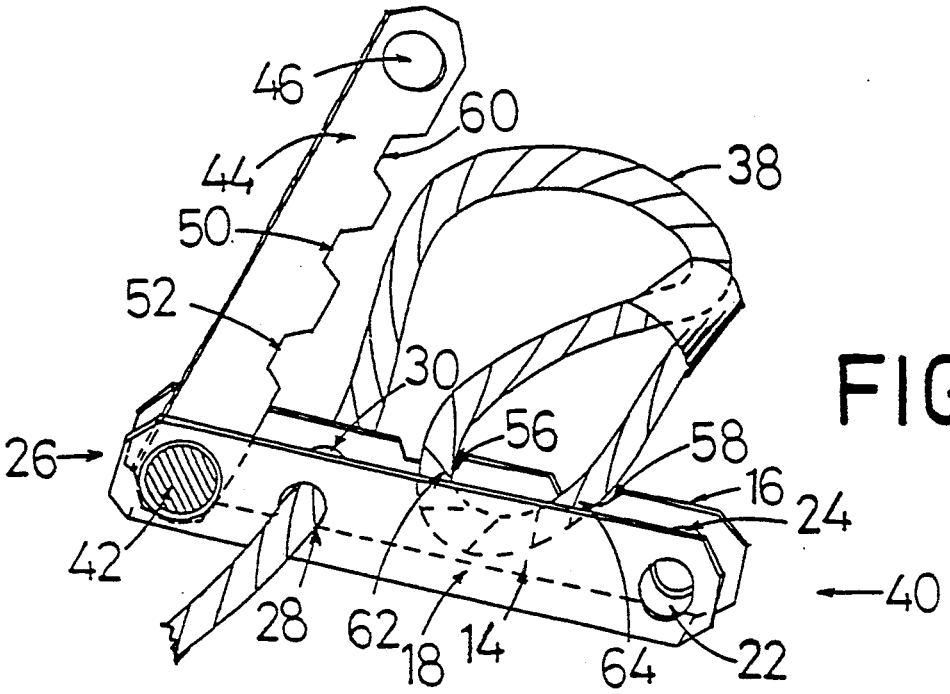
FIG. 3 is a perspective view of an alternate embodiment of the locking device shown in a disengaged position.
Figure 4:
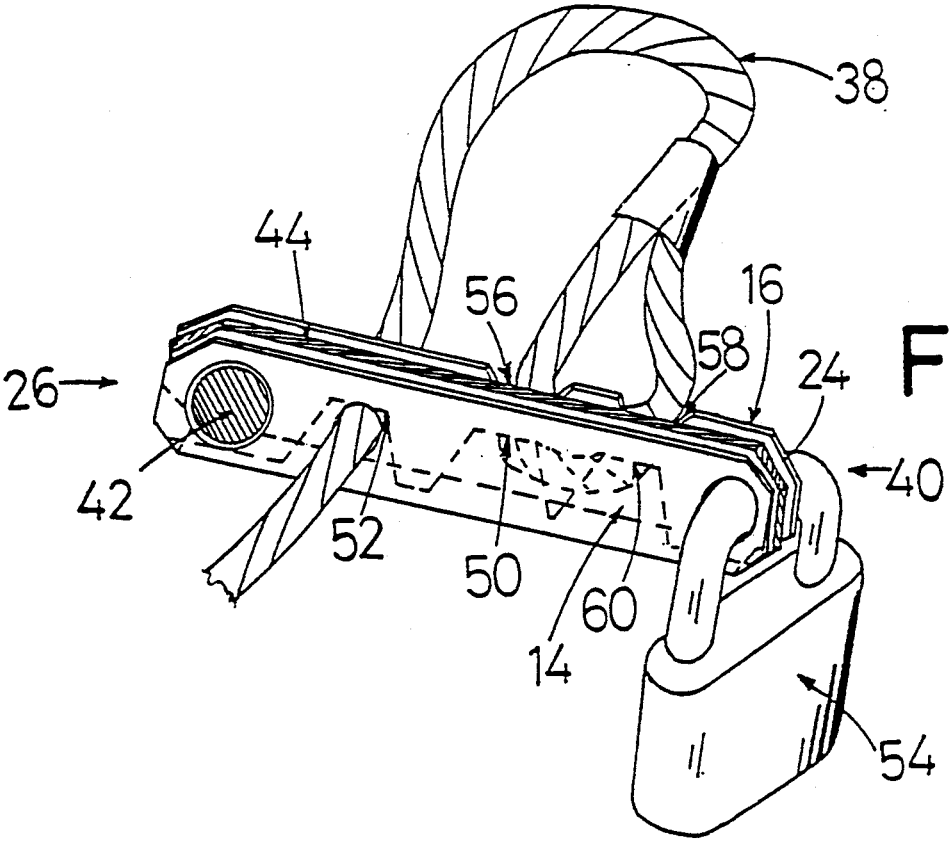
FIG. 4 is a perspective view of the locking device in FIG. 3 shown in an engaged position.

In another embodiment of the invention, shown in FIGS. 3 and 4, a side wall 14 or 16, shown in the drawings by reference numeral 16, includes a pair of spaced apart openings 56, 58 extending downwardly from the top 36. Cable retaining element 44 includes, in this embodiment an additional opening 60 which is spaced apart from openings 50 and 52. In this arrangement when element 44 is engaged within body 12, opening 52 positively contacts and engages cable 38, extending through apertures 28 and 30, while openings 50 and 52 similarly engage portions 62 and 64 of cable 38; aperture 46 registers with apertures 22 and 24 of body 12 similar to FIGS. 1 and 2.

In other embodiments, the locking device body may be of a different shape, e.g. circular, with a correspondingly shaped cable retaining element. Additionally, the openings which receive the cable may be positioned in different locations to provide alternatives to those shown in the drawings.

As those skilled in the art will realize, these preferred illustrated details can be subjected to substantial variation, without affecting the function of the illustrated embodiments. Thus, although embodiments of the invention have been described above, it is not limited thereto and it will be apparent to those skilled in the art that numerous modifications form part of the present invention insofar as they do not depart from the spirit, nature and scope of the claimed and described invention.

THE EMBODIMENTS OF THE INVENTION IN WHICH AN EXCLUSIVE PROPERTY OR PRIVILEGE IS CLAIMED ARE DEFINED AS FOLLOWS:

1. A locking device comprising:

a body member, said body member having first and second spaced apart apertures therethrough, said first aperture being adapted to receive a length of flexible cable having opposed ends, at least one of said ends being looped, said body further including a recessed opening therein, said recessed opening including at least one groove adapted to receive at least one of said looped ends of said cable, said groove spaced from and between said first and second apertures; and a pivotable cable retaining member, said member being pivotally associated with one of said ends of said body, said retaining member having first and second spaced apart openings therein and an aperture extending through an end thereof movable from an engaged position with said opening of said body and said first and second openings and said aperture of said retaining member are engaged with said first aperture, said groove and said second aperture of said body to engage a cable therein to a disengaged position wherein said cable retaining member is out of engagement with said opening of said body.

2. The locking device as defined in claim 1, wherein said aperture of said retaining member and said second aperture of said body, when in registration, are adapted to receive lock means.

3. The locking device as defined in claim 1, wherein said body includes opposed ends.

4. The locking device as defined in claim 1, wherein said recesses opening of said body comprises a slot.

5. The locking device as defined in claim 1, wherein said retaining member comprises a finger.

6. The locking device as defined in claim 1, wherein said first and second spaced apart openings of said retaining member frictionally engages said cable in an engaged position with said body.

7. The locking device as defined in claim 1, wherein said cable is slidably adjustable within said first aperture of said body when said retaining member is out of engagement with said opening of said body.

8. The locking device as defined in claim 1, wherein said body comprises a rigid material.

9. The locking device as defined in claim 1, wherein said retaining member comprises a rigid material.

* * * * *